US005628303A

United States Patent [19]

Ahmady et al.

[11] Patent Number: 5,628,303

[45] Date of Patent: May 13, 1997

[54] RADIANT SPACE HEATER FOR RESIDENTIAL USE

[75] Inventors: Farshid Ahmady, Rochester Hills; Srinivas C. Duvvuri, Sterling Heights, both of Mich.

[73] Assignee: Solaronics, Inc., Rochester, Mich.

[21] Appl. No.: 603,717

[22] Filed: Feb. 20, 1996

[51] Int. Cl.[6] ..... F24C 3/00

[52] U.S. Cl. ..... 126/91 A; 126/92 AC; 431/19; 431/354

[58] Field of Search ..... 126/91 A, 92 R, 126/92 AC, 110 R, 110 B, 116 A; 431/354, 345, 19, 351; 392/436, 437; 165/49; 237/70

[56] References Cited

U.S. PATENT DOCUMENTS

| | | | |
|---|---|---|---|
| 3,603,764 | 9/1971 | Martin | 392/436 |
| 4,044,751 | 8/1977 | Johnson | 126/91 A |
| 4,107,512 | 8/1978 | Brandenburg, Jr. | 165/49 |
| 4,390,125 | 6/1983 | Rozzi | 126/92 B |
| 4,529,123 | 7/1985 | Johnson | 237/1 R |
| 4,740,158 | 4/1988 | Johnson | 432/59 |
| 4,798,192 | 1/1989 | Maruko | 126/91 A |
| 5,370,529 | 12/1994 | Lu et al. | 431/354 |
| 5,429,112 | 7/1995 | Rozzi | 126/91 A |

FOREIGN PATENT DOCUMENTS

| | | | |
|---|---|---|---|
| 846237 | 8/1960 | United Kingdom | 126/91 A |

OTHER PUBLICATIONS

Space-Ray-"Cold Blocker Infrared Gas Tube Heaters" Flyer (1 pg.) Feb. 1995.

Space-Ray "Installation and Operating Instructions", Dec. 1993, pp. 1, 4, 17.

"Todays Choice in Gas Infra-Red Radiant Tube Heater" Advertising Brochure by Sun Technology Corp. (2 pgs.).

"DSB Series-Residential Radiant Tube Heater" Operation, Installation, Maintenance & Parts Manual by Detroit Radiant Products Co., Sep. 1993, 4 pgs.

*Primary Examiner*—James C. Yeung

*Attorney, Agent, or Firm*—Young & Basile, P.C.

[57] ABSTRACT

A compact gas-fired radiant space heater is adapted for residential use, having an output in the 20k BTU to 40k BTU/hr range and exterior dimensions small enough to allow it to be installed in a standard two foot by four foot suspended ceiling opening. A radiator tube having a total length of approximately 15 feet is bent into a serpentine shape, and combustion control components are housed within a plenum chamber supplying combustion air to the tube, both the tube and the chamber being encircled by a frame that fits within the two foot by four foot opening. The combustion control components are attached to a chassis plate whereby the components are removable from the plenum chamber as a unit to enhance serviceability of the heater. A burner venturi of novel configuration produces a flame that is less than four feet long yet which is relatively quiet. An air flow switch senses the dynamic pressure of an air stream issuing from a fan which pressurizes the plenum chamber, shutting off the supply of gas to the burner if the pressure reading indicates unacceptably low air flow.

6 Claims, 4 Drawing Sheets

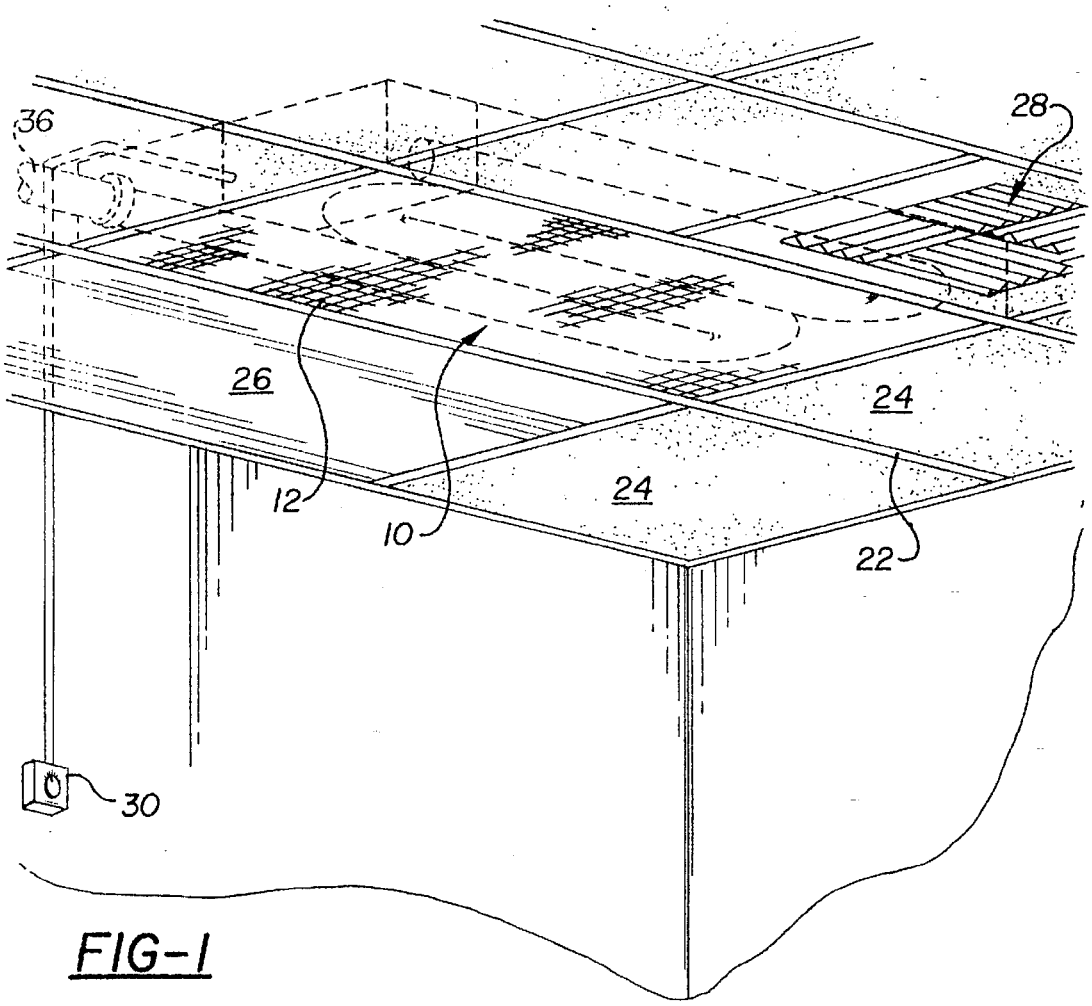
FIG-1
FIG-4
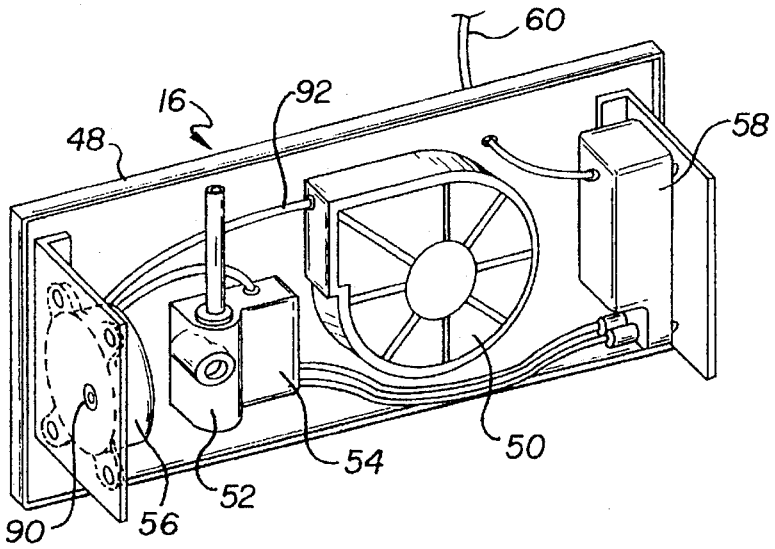

RADIANT SPACE HEATER FOR RESIDENTIAL USE

FIELD OF THE INVENTION

The present invention relates to gas-fired radiant space heaters of the type comprising a burner and an elongated radiator tube with reflective shield usually disposed overhead in the area to be heated, and more particularly to such a heater that is adapted for residential use by virtue of being compact enough to fit within a standard sized 2'×4' suspended ceiling panel unit, having a burner venturi of unique design to yield quiet combustion, having electromechanical components located so as to be easily serviced and maintained, and utilizing a simplified method of detecting unsafe air flow conditions.

BACKGROUND OF THE INVENTION

Radiant energy heating systems are commonly used in industrial and commercial buildings. Radiant heater systems are more efficient and cost-effective than forced air systems because the emitted infrared rays heat objects and concrete floors rather than large volumes of air. The concrete floors absorb the radiant energy and re-radiate it back into the surrounding air to maintain a blanket of warmth within the heated space. By thus heating from the bottom up, the stratification of heat within the building that tends to occur with a forced air system is minimized, with consequent improvements in comfort and fuel efficiency.

Some radiant space heating systems are supplied in component form, the radiator tube of the installed system being built up from various straight and curved sections as needed to route the radiator tube through the area of the building where heating is desired. In such a system, a burner unit is located at a first end of the tube and an exhaust fan is typically located at the opposite end of the tube to draw the hot effluent through the tube. Alternatively, a radiant heater may be manufactured and delivered as an assembled unit comprising an elongated, U-shaped radiator tube, a burner unit, and an exhaust fan. A reflector is disposed above the radiator tube to direct the radiant energy in the desired direction. The unit is provided with hangers which permit it to be suspended from a ceiling or other overhead structure. Such radiant heater units intended for industrial or commercial use and rated at 20k BTU/hour to 50k BTU/hour are typically over 10 feet in overall length.

Scaled down versions of the above-described radiant heater units have been produced and marketed for use in residential heating applications. Such residential units have been six feet or more in overall length, and therefore can not be mounted within the standard two foot by four foot openings in suspended ceiling systems.

If a conventional U-tube radiant heater is scaled down to have an overall length of less than six feet, the total length of the radiator tube is reduced to the point where the exhaust effluent still contains significant useful thermal energy. This leads to a reduction in the efficiency of the heater, and requires that the exhaust ducting be able to withstand higher temperatures.

Another reason why it has not previously been practical to produce a radiant heater in the 20k–40k BTU/hr range having an overall length of four feet or less is that burners as heretofore used to produce heat outputs in that range generate a flame which is well over four feet long. Even using a U-shaped radiator tube, the tube can not have a straight segment more than four feet long, so that the flame must impinge on the inner surface of the radiator tube in the vicinity of the 180° bend. Impingement on the flame on the tube causes quenching of the flame, with a consequent increase in undesirable emissions such as carbon monoxide. The flame also crates a hot-spot on the radiator tube, which results in premature oxidation of the tube material and eventual burn-through.

It is possible to decrease the length of the flame produced by the burner by increasing the amount of air flow through the burner venturi. Conventional methods for achieving this increase in what is known as the primary air flow involve either a) enlarging the diameter of the venturi or b) increasing the pressure of the air drawn or forced through the venturi. Both of these options have effects that are undesirable in a heater unit for residential use.

Increasing the venturi diameter is undesirable because it forces an increase in the diameter of the radiator tube in order to maintain adequate clearance between the exterior of the venturi and the interior of the surrounding radiator tube. Sufficient clearance must be maintained to permit the flow of air around the outside of the venturi, the flow of this so-called secondary air being critical in cooling the radiator tube containing the flame. An increase in radiator tube diameter increases the depth of the unit, and also forces an increase in the radius of the bend connecting the straight segments of the tube so that they must lie farther apart, thus making the unit wider.

The other possibility, increasing the air velocity through the burner, leads to an increase in the level of noise made by combustion, the fast-burning flame making a "roaring" sound. In a residential application it is particularly important that the heater operate quietly.

Another drawback inherent in prior radiant heaters is that electromechanical components of the heater, such as the fan, gas supply valve and electronic control unit, are difficult to service and inspect when the heater is installed in an overhead position. Servicing and/or inspection of these components involves either working on the heater in its installed position, or removing the entire heater from its installed position and moving it to a location where the components are more easily accessed.

Some gas-fired radiant heaters include what is known in the art as an air flow switch, a mechanism for determining the amount of air being provided to the burner and shutting off the flow of gas if the air flow is not sufficient for proper functioning of the heater. Air flow may be reduced by any number of problems, for example a malfunctioning or blocked fan, or a blockage anywhere along the radiator tube or its exhaust ducting.

In a heater having a pressurized plenum chamber supplying air to the burner, the air flow monitoring function is generally accomplished by a pair of pressure actuated switches located within the plenum chamber and wired to a control unit which cuts off the flow of gas through the valve if the pressure switches indicate that the pressure within the chamber is not within the acceptable range. One switch is actuated and sends a flow termination signal to the control unit if the pressure in the plenum chamber drops below a predetermined minimum, such as would occur if the fan were to slow or stop. The other switch sends a flow termination signal if the pressure rises above a predetermined maximum, such as would occur if the radiator tube or exhaust were blocked at any point downstream.

The cost and complexity of the heater could be reduced if the air flow switch function could be accomplished with only one pressure switch requiring a single electrical connection to the control unit.

BRIEF SUMMARY OF THE INVENTION

The present invention provides a gas-fired radiant space heater with a rating in the 20k–40k BTU/hour range and which is adapted for residential-type use by virtue of: a) being compact enough to fit within a standard sized 2'×4' suspended ceiling panel unit; b) being quiet in operation; c) having electromechanical components located so as to be easily serviced and maintained, and d) utilizing a simplified method of detecting unsafe air flow conditions. In general, the overall size limitation is met by locating all of the operative components of the heater within the perimeter of a rectangular frame sized fit within a standard-sized 2'×4' suspended ceiling panel opening. The radiator tube is formed in a zig-zag or serpentine shape so that it is of sufficient total length to yield an adequate level of heat transfer while still lying wholly within the frame, and substantially all electromechanical combustion control components associated with the burner are positioned within a plenum chamber that also lies wholly within the frame.

According to a feature of the invention, the burner venturi has a throat diameter to inlet end diameter ratio of from approximately 0.3 to approximately 0.4 and a divergent cone angle of approximately 30°. When supplied with fuel gas at a rate providing a heat output in the range of from 20k BTU/hr to 40k BTU/hr along with sufficient air to achieve stoichiometric combustion, this venturi geometry has been found to produce a flame less than four feet in length without producing an unacceptable amount of noise.

According to another feature of the invention, the combustion control components housed within the plenum chamber are attached to a chassis to form a combustion control module which is detachably secured to the heater. The module may be detached and removed from the plenum chamber as a unit so that the components may be inspected and/or serviced at a convenient location remote from the heater, without time-consuming disassembly of the heater.

According to another feature of the invention, the combustion control components secured to the chassis comprise an electric fan for generating a flow of air to pressurize the plenum chamber, a gas supply valve for delivering a metered amount of gas to the burner, an electrically operated valve regulator for opening and closing the valve as required by operating condition, an electronic control unit for controlling operation of the heater, and an air flow switch for signalling the electronic control unit to close the valve if the flow of air into the radiator tube becomes insufficient for safe operation of the heater. These five combustion control components combine to provide safe and reliable operation of the heater unit.

According to a further feature of the invention, the air flow switch determines the amount of air being supplied to the tube by sensing the velocity of the air stream issuing from the fan. The air flow switch contains a pressure switch that reacts to the dynamic pressure at a point in the outlet stream of the fan. The dynamic pressure is sensed by positioning a first pressure tap in the fan outlet stream and a second pressure tap at a point within the plenum chamber remote from the fan. The switch is actuated by the pressure differential between the two taps. If the dynamic pressure drops below a lower limit, the air flow switch sends a signal to the electronic control unit instructing it to close the gas supply valve. Since the air flow velocity through the fan drops as a result of stoppage or blockage of the fan as well as blockage of the radiator tube at any point downstream, an air flow switch that senses dynamic pressure protects against any of these conditions. Only one pressure switch with one electrical connection to the electronic control unit is required, rather than two as in the prior art, with consequent reduction in cost and complexity of the control system.

These and other features and advantages of the present invention will become more apparent upon reading of the following detailed description in view of the accompanying drawings.

BRIEF DESCRIPTION OF THE DRAWINGS

FIG. 1 is an environmental view of the invention radiant heater installed in a panel of a suspended ceiling;

FIG. 4 is a perspective view of a combustion control module according to the invention;

DETAILED DESCRIPTION OF THE PREFERRED EMBODIMENT

Figure 3:
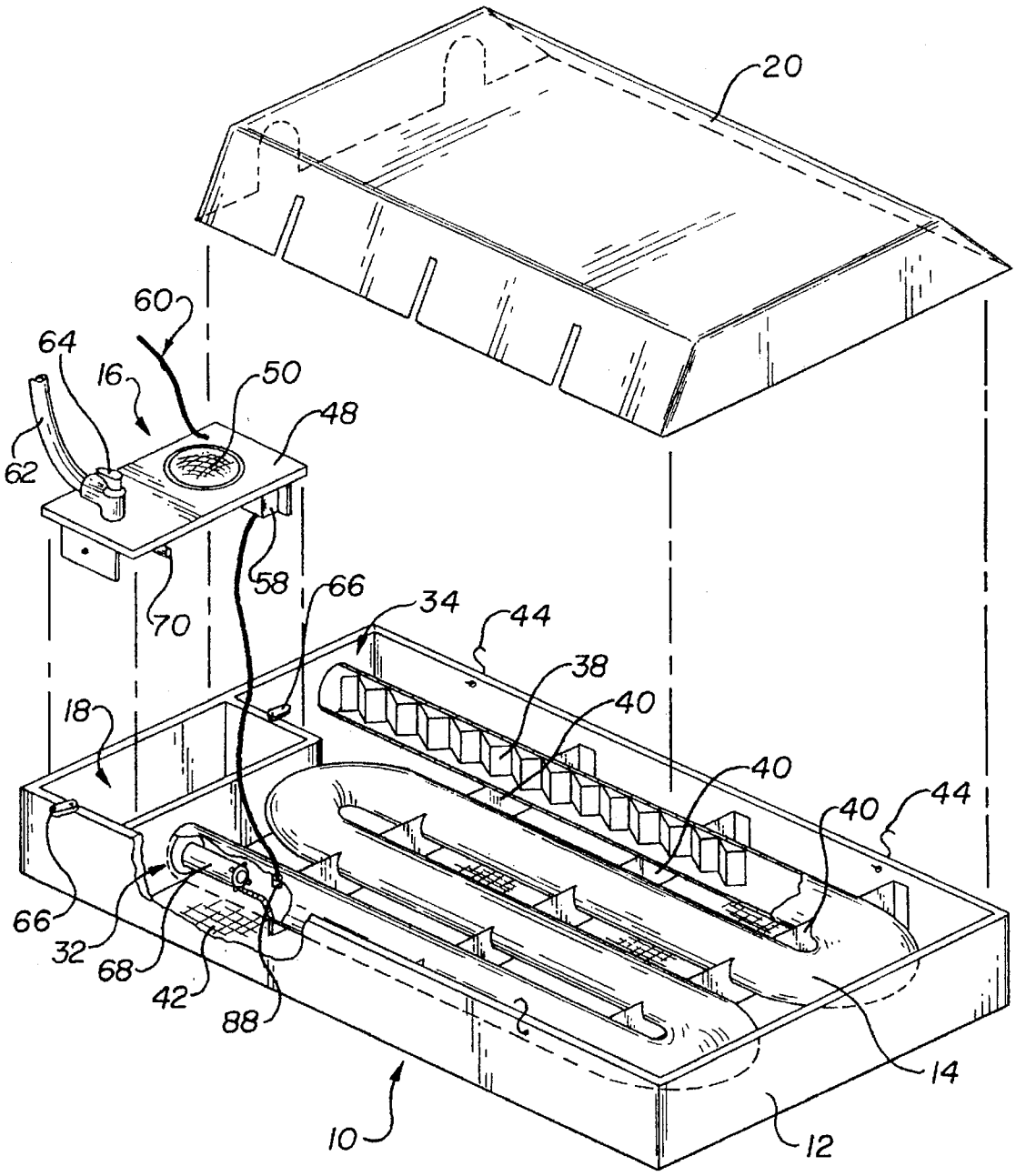
FIG. 3 is a partially exploded perspective view of the invention radiant heater.

Referring to the drawings, FIGS. 1 and 3 illustrate a radiant heater 10 according to the present invention generally ,comprising a rectangular frame 12 formed from bent and welded heavy gauge sheet metal, a four-leg or serpentine radiator tube 14 lying wholly within the frame, a combustion control module 16 housed within a plenum chamber 18 located at a corner of the frame, and a pan-shaped reflector 20 which overlays the top of the entire radiator tube and extends downwardly around its perimeter.

Figure 2:
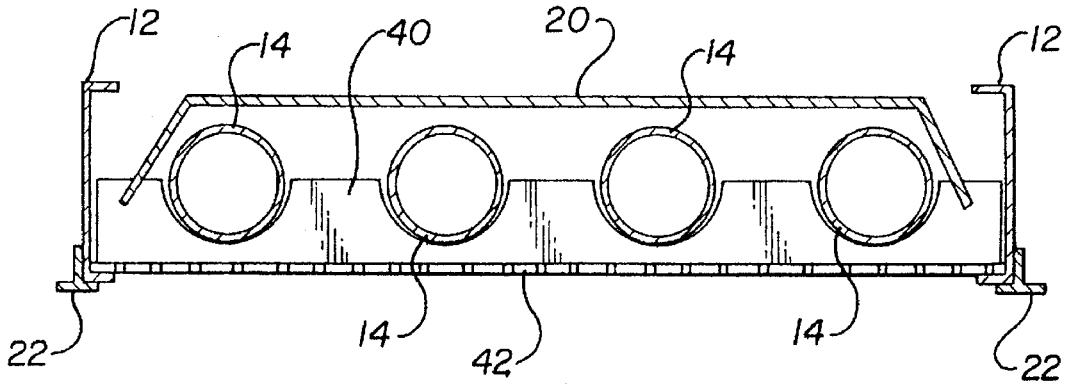
FIG. 2 is a cross sectional view of the invention radiant heater in the suspended ceiling installation of FIG. 1.

Radiant heater 10 is adapted for the installation depicted in FIGS. 2 and 3, wherein the unit is installed in a standard, commercially available suspended ceiling system comprising a framework of small metal struts 22 defining rectangular openings and supporting acoustic tile panels 24 and other fixtures. In the suspended ceiling systems commonly used in homes, offices and commercial buildings, the openings defined by the beams measure two feet wide by four feet long, with light fixtures 26, HVAC vents 28, and other fixtures are available in standard sizes to be compatible therewith. FIG. 2 shows the manner in which radiant heater 10 nests between and is supported by struts 22. When mounted in a suspended ceiling or in any other overhead installation, operation of the radiant heater is preferably controlled by a thermostatic temperature control 30 mounted to a wall in or near the space to be heated.

In the depicted embodiment, radiator tube 14 comprises four straight segments aligned substantially parallel to one another and interconnected at their ends by 180° bends to form a continuous flow path approximately 15 feet long. In the preferred embodiment, radiator tube 14 is bent from a single length of 2¾ inch diameter, 14 gauge aluminized steel tube, with an inside diameter of 2.6 inches. Radiator tube 14 has an inlet end 32 that opens into plenum chamber 18, and an opposite exhaust end 34 passing through a hole in frame 12 at an adjacent corner of the frame. An exhaust duct 36 connects to exhaust end 34 and vents radiator tube 14 outside of the building in which the heater is installed. A baffle or turbulator 38 is positioned inside of radiator tube 14 adjacent exhaust end 34.

Frame 12 is approximately four feet long and two feet wide, and plenum chamber 18 is defined by two vertical sheet metal walls welded in place at a corner of the frame. Tube supports 40 extend transversely across the inside of frame 12 and are spot welded or otherwise secured to the inside of frame 12 at their ends. Tube supports 40 are formed of sheet metal and have radiused notches formed in the upper edges thereof to receive and support the straight segments of radiator tube 14.

An "egg crate" grill 42 is formed of metal and lies inside of frame 12 beneath radiator tube 14 and tube supports 40. A plurality of hanger hooks 44 engage holes positioned around the perimeter of frame 12 to allow radiant heater 10 to be suspended from a ceiling or other overhead structure. A sight glass 46 on the underside of radiator tube 14 adjacent inlet end 32 provides a means by which the flame can be viewed to determine whether or not the heater is operating.

Combustion control module 16, as seen in detail in FIG. 4, comprises an aluminum chassis plate 48, an electric fan 50 mounted over a circular opening in the chassis plate, a gas valve 52 and its attached valve regulator 54, an air flow switch 56, and an electronic control unit 58. Fan 50, gas supply valve 52, valve regulator 54, air flow switch 56, and electronic control unit 58 are electrically interconnected to operate in a manner to be fully described below, with electrical power supplied to the module by an electric cord 60 connected to electronic control unit 58. In the preferred embodiment fan 50 has an open-air flow rating of 25 cubic feet per minute (cfm), and provides a flow rate as installed of approximately 10 cfm.

Valve 52 is connected to a fuel gas supply (not shown) by gas line 62, and is preferably adjustable by the user between a plurality of gas flow settings to vary the heat output of radiant heater 10. In the preferred embodiment of the invention, gas supply valve 52 is adjustable by turning an output lever 64 located on the upper side of chassis plate 48 where gas line 62 connects to the valve, and gas flow rates corresponding to between approximately 20k and 40k BTU/hour are selectable. This heat output range equates to a flow rate of approximately from 20 cubic feet per hour (cfh) to 40 cfh for natural gas, and a flow rate of approximately from 8 cfh to 16 cfh for propane.

Combustion control module 16 is operatively positioned so that fan 50, valve 52, regulator 54, air flow switch 56, and electronic control unit 58 are contained within plenum chamber 18, with chassis plate 48 closing off the upper side of the chamber. Hold-down tabs 66 are pivotingly attached to the side walls of plenum chamber 18 and are rotatable to extend over the chassis plate to secure the module in place.

Figure 5:
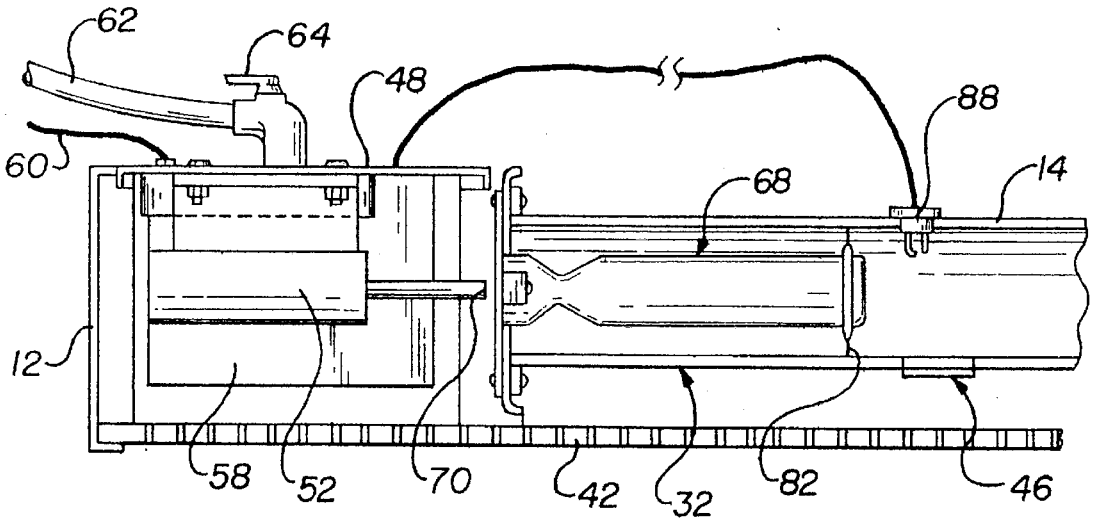
FIG. 5 is a partial cross sectional view of the invention radiant heater showing the combustion control module and a burner venturi according to the present invention.

As best seen in FIG. 5, a burner venturi 68 is retained concentrically inside of radiator tube 14 immediately adjacent inlet end 32. When burner venturi 68 is so positioned, a gas delivery orifice 70 of valve 52 is located immediately adjacent the end of the burner venturi.

Figure 6:
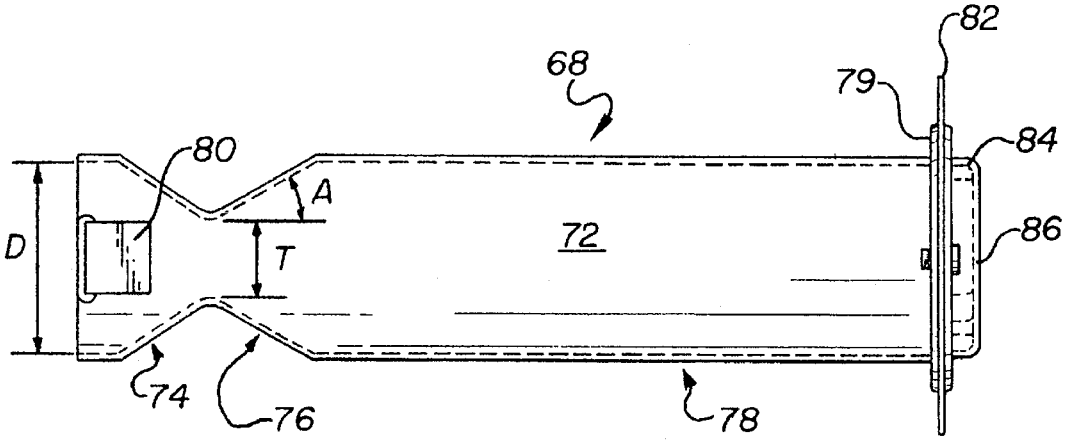
FIG. 6 is a side view of the burner venturi of FIG. 5.
Figure 7:
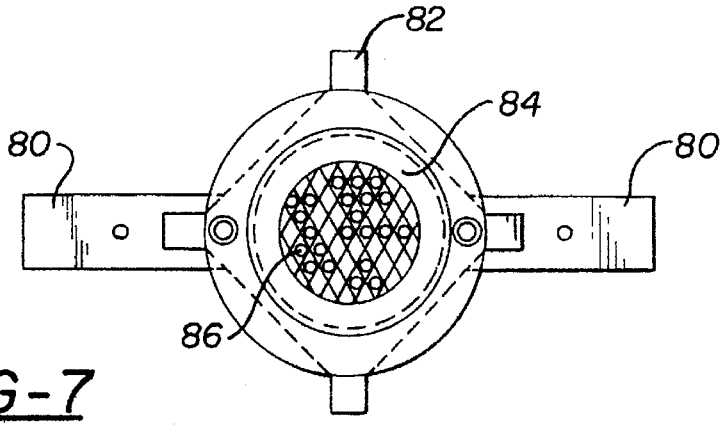
FIG. 7 is an end view of the burner venturi of FIG. 5.

As indicated in FIG. 6, burner venturi 68 has a body 72 with an overall inside diameter of D and comprises an inlet bell portion 74 wherein it converges to a throat internal diameter T, a divergent cone 76 wherein it widens back to diameter D, and an outlet portion 78 terminating is a radial flange 79. In accordance with the present invention, the ratio of throat diameter T to inlet diameter D is in the range of approximately 0.3 to 0.4. This value is significantly smaller than the 0.7 ratio that is customary for venturis used in conventional radiant heaters.

The angle of divergent cone 76, known as the opening angle and indicated by A in FIG. 6, is in the range of approximately 25° to 35°. This is much steeper than the opening angle used in prior art radiant heater venturis, where an angle of approximately 2° is customary in order to avoid turbulent flow in the transition region and consequent back-pressure through the venturi.

Figure 8:
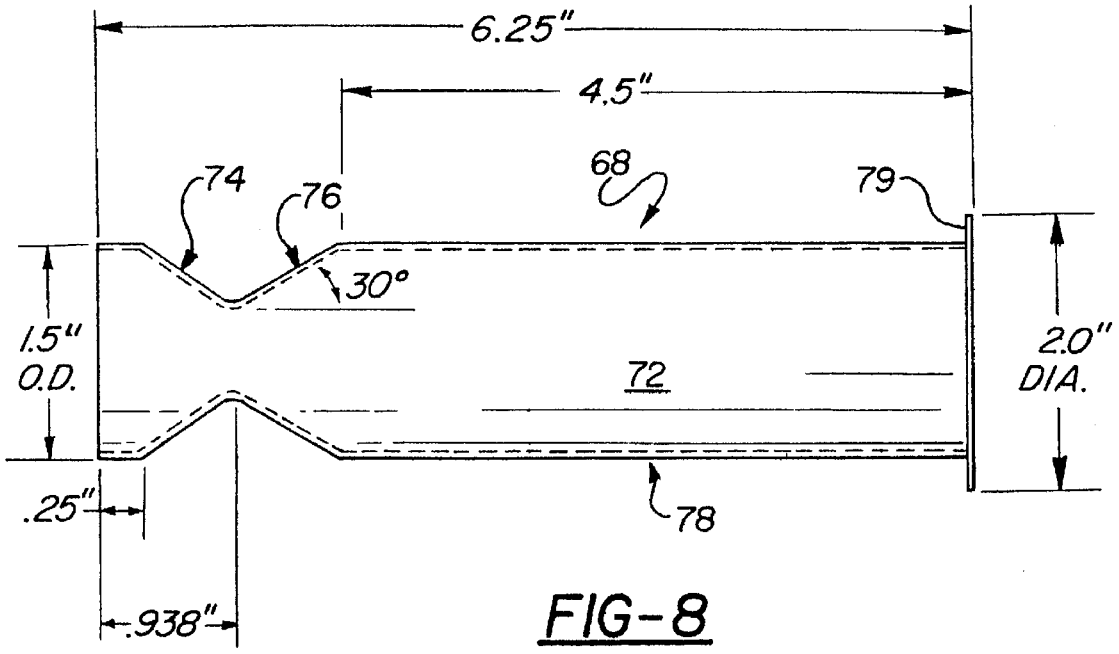
FIG. 8 is a detail of a burner venturi body according to the present invention, showing dimension of a preferred embodiment.

In a preferred embodiment of the invention, burner body 72 is formed from a piece of 20 gauge, 1.5 inch outside diameter steel tubing, and has the dimensions indicated in FIG. 8.

Burner venturi 68 has mounting tabs 80 extending radially from inlet bell 74, and a cruciform centering plate 82 and a tile retainer ring 84 are rivetted to radial flange 79. Tile retainer ring 84 holds a perforated ceramic tile 86 of the type known in the art over the open end of burner venturi 68. The outer ends of mounting tabs 80 are secured to the inner surface of plenum chamber 18 by sheet metal screws or the like, and this attachment along with centering plate 82 maintains burner venturi 68 concentrically within radiator tube 14.

An ignitor/flame sensor 88 of the type well known in the gas burner art projects into radiator tube 14 through a hole immediately adjacent the end of burner venturi 68, and is electrically connected to electronic control unit 58. Temperature control 30 (see FIG. 1) is also connected to electronic control unit 58.

OPERATION OF THE HEATER

When the ambient temperature drops below the temperature set on temperature control 30, electronic control unit 58 is activated to begin the heater start-up sequence. Electronic control unit 58 first supplies electrical power to fan 50, and operation of the fan draws air in through the opening in chassis plate 48 to create a positive pressure inside of plenum chamber 18. When, in a manner to be described in more detail below, air flow switch 56 senses an air flow velocity from fan 50 above a minimum allowable level, it sends a signal to electronic control unit 58 that allows electronic control unit 58 to energize valve regulator 54, thereby opening valve 52 so that fuel gas is delivered through orifice 70. Valve 52 is biased to the closed position, and only remains open as long as regulator 54 is energized by electronic control unit 58.

The positive pressure within plenum chamber 18 causes air to flow into radiator tube 14, and so through burner venturi 68. This air flow induces the fuel gas delivered from orifice 70 to flow into and through burner venturi 68. Substantially simultaneously with the opening of valve 52, electronic control unit 58 energizes ignitor/flame sensor 88, the ignitor providing continuous spark ignition for a period of approximately three to five seconds to ignite the gas/air mixture issuing from burner venturi 68.

Ignitor/flame sensor 88 also provide an electrical signal to electronic control unit 58 indicating whether or not a flame is present within radiator tube 14. If no flame is detected, the electronic control unit 58 deenergizes valve regulator 54 to close valve 52 and terminate the flow of gas.

Air flow switch 56 contains a pressure actuated switch that reacts to the differential between a first pressure at a pressure port 90 on the body of the air flow switch and a second pressure at the end of pressure tube 92 extending into the outlet opening of fan 50. Pressure port 90 is located at a point within plenum chamber 18 where there is no significant air flow velocity, and so the port senses static pressure within the plenum chamber. The end of pressure tube 92, however, points directly into the air stream issuing from fan 50 and so senses the total pressure, i.e. static pressure plus dynamic pressure, at that point.

By essentially subtracting the static pressure reading at port 90 from the total pressure reading at pressure tube 92, the pressure actuated switch reacts to the dynamic pressure generated by fan 50, this dynamic pressure being directly proportional to the velocity of the air stream generated by the fan. The velocity of the air stream decreases if fan 50 slows, stops, or is blocked, and also if radiator tube 14 is blocked at any point downstream from the plenum chamber 18.

If air flow switch 56 detects a dynamic pressure below a lower limit selected to coincide with a level of air flow ensuring safe operation of the heater, the air flow switch sends a signal to electronic control unit 58 which causes it to deenergize gas regulator 52, thereby closing valve 52.

If radiant heater 10 is functioning normally, however, electronic control unit 58 maintains valve regulator 54 in an energized state so that valve 52 is open and supplies fuel gas to burner venturi 68 at a flow rate of 20k to 40k BTU/hr as determined by the position of output lever 64. When this fuel is delivered to burner venturi 68, combustion of the fuel is completed rapidly so that the flame produced is under four feet long and accordingly does not extend past the end of the straight segment of radiator tube 14 and impinge on the bend. In spite of the rapid burning of the fuel, the invention burner has been found to be relatively quiet, failing to produce the "roar" that has been characteristic of previous attempts to achieve a short flame length.

Combustion control module 16 may be detached from radiant heater 10 and removed as a unit from plenum chamber 18 to provide unrestricted and convenient access to the combustion control components for maintenance, inspection, or other servicing. If radiant heater 10 is mounted in a suspended ceiling panel as shown in FIGS. 1 and 2, access to combustion control module 16 is gained by displacing upwardly and sliding aside one of the acoustic tiles 24 adjacent to the heater unit. Hold-down tabs 66 are then rotated out of interference with chassis plate 48, permitting module 16 to be lifted out of plenum chamber 18. The wire connecting electronic control unit 58 with ignitor/flame sensor 88 may be disconnected if it is desired to completely separate the control module from the heater unit. Electric cord 60 and gas line 62 may be disconnected if it is necessary to transport module 16.

As is apparent from the foregoing description and drawings, the invention radiant heater provides a compact radiant heater unit adapted for use in residential-type applications by virtue of its small exterior dimensions and its quiet operation. Further, the easily detachable and removable combustion control module provides for convenient servicing and inspection of the heater components. The use of an air flow sensor that directly measures air flow velocity delivered from the fan provides a gas shut-off safety feature in a less complicated manner than has been achieved in the past.

Whereas a preferred embodiment of the invention has been illustrated and described in detail, it will be apparent that various changes may be made in the disclosed embodiment without departing from the scope or spirit of the invention.

We claim:

1. A gas-fired radiant space heater comprising a radiator tube having an inlet end, a plenum chamber in communication with the inlet end of the tube, and combustion control means comprising a plurality of operatively interconnected components for supplying a combustible mixture of air and fuel gas to a burner adjacent the tube inlet end, the radiator tube, plenum chamber and combustion control means disposed essentially in a plane, the radiant heater characterized in that:

substantially all of the components making up the combustion control means are located within the plenum chamber and secured to a chassis, the chassis being detachable and removable from the heater in a direction substantially perpendicular to the plane of the heater in order to remove the combustion control means as a unit from the plenum chamber.

2. A gas-fired radiant space heater according to claim 1 wherein the burner comprises a venturi mounted inside of the radiator tube and separately from the chassis, whereby the chassis is removable from the plenum chamber without removing the venturi from the radiator tube.

3. A gas-fired radiant space heater wherein a radiator tube is supplied with a combustible mixture of fuel gas and air, said mixture being supplied by combustion control means comprising a fan for generating a flow of air to pressurize a plenum chamber in communication with an inlet end of the radiator tube, a gas valve for metering the supply of the fuel gas to the tube, and air flow switch means for sensing the amount of air supplied to the tube and actuable in response to the amount of air supplied to the tube being insufficient for safe and proper operation of the heater, actuation of the switch means resulting in closing of the gas valve, the radiant heater characterized in that:

the air flow switch means senses a pressure differential between a dynamic pressure at a first point immediately adjacent an outlet opening of the fan and a static pressure at a second point within the plenum chamber remote from the fan, and is actuable by the pressure differential being below a minimum value.

4. A gas-fired radiant space heater in the 20k to 40k BTU/hr range comprising a burner venturi for producing a flame by burning of a combustible mixture of air and fuel gas, combustion control means for controlling the supply of the combustible mixture to the burner venturi, and a radiator tube comprising at least a first straight segment adjacent the burner venturi for containing the flame and a second straight segment connected with the first straight segment by a contiguous 180° bend, the radiant heater characterized in that:

the first straight segment is less than approximately four feet long; and the burner venturi has a throat diameter to inlet end diameter ratio of from approximately 0.3 to approximately 0.4 and a divergent cone angle of from approximately 25° to 35°, whereby the burner venturi when supplied with fuel gas and air in a stoichiometric ratio produces a flame that is shorter than the length of the first straight segment and does not impinge on the 180° bend.

5. The heater of claim 4 wherein:

the radiator tube and the combustion control means are substantially surrounded by a rectangular frame having an outer perimeter measuring not greater than approximately two feet wide by not greater than approximately four feet long.

6. The heater of claim 4 wherein:

the radiator tube further comprises a third straight segment connected to the second straight segment by a second contiguous 180° bend to form a serpentine configuration having a total length of approximately fifteen feet.

* * * * *